US011104536B2

(12) United States Patent
Wagner et al.

(10) Patent No.: US 11,104,536 B2
(45) Date of Patent: Aug. 31, 2021

(54) METHOD FOR INTRODUCING A MATERIAL WEB INTO A CORRUGATING DEVICE

(71) Applicant: BHS Corrugated Maschinen- und Anlagenbau GmbH, Weiherhammer (DE)

(72) Inventors: Maximilian Wagner, Waldkraiburg (DE); Markus Fischer, Mantel (DE); Michael Dehling, Sulzbach-Rosenberg (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 14 days.

(21) Appl. No.: 16/555,497

(22) Filed: Aug. 29, 2019

(65) Prior Publication Data

US 2020/0071109 A1 Mar. 5, 2020

(30) Foreign Application Priority Data

Aug. 31, 2018 (DE) ..... 10 2018 214 853.8

(51) Int. Cl.
*B65H 19/12* (2006.01)
*B31F 1/20* (2006.01)
*B65H 19/10* (2006.01)

(52) U.S. Cl.
CPC ..... *B65H 19/12* (2013.01); *B31F 1/20* (2013.01); *B65H 19/102* (2013.01); *B65H 2301/41427* (2013.01)

(58) Field of Classification Search
USPC ..... 162/193; 156/64
See application file for complete search history.

(56) References Cited

U.S. PATENT DOCUMENTS

| | | | | | |
|---|---|---|---|---|---|
| 4,853,072 | A * | 8/1989 | Thompson | B31F 1/2818 | 156/470 |
| 5,244,518 | A * | 9/1993 | Krayenhagen | B31F 1/284 | 156/351 |
| 5,676,790 | A * | 10/1997 | Burrows | B31F 1/2831 | 156/210 |
| 6,153,037 | A * | 11/2000 | Kim | B31F 1/28 | 156/205 |
| 6,238,198 | B1 * | 5/2001 | Hatasa | B31F 1/2868 | 156/462 |
| 2001/0035248 | A1 * | 11/2001 | Sato | B65H 19/105 | 156/64 |
| 2003/0056886 | A1 * | 3/2003 | Schmidt | B31F 1/2845 | 156/210 |
| 2004/0177912 | A1 * | 9/2004 | Burrows | B31F 1/2831 | 156/64 |
| 2008/0308215 | A1 * | 12/2008 | Kraus | B31F 1/2822 | 156/207 |
| 2015/0290899 | A1 * | 10/2015 | Ohira | B31F 1/2818 | 156/470 |

FOREIGN PATENT DOCUMENTS

| | | | |
|---|---|---|---|
| DE | 19717078 | A1 | 10/1998 |
| DE | 19841565 | C1 | 12/1999 |
| DE | 69720214 | T2 | 12/2003 |
| DE | 102016209388 | A1 | 11/2017 |
| DE | 102016012760 | A1 | 4/2018 |
| EP | 1 149 788 | A2 | 10/2001 |

* cited by examiner

*Primary Examiner* — Mark Halpern
(74) *Attorney, Agent, or Firm* — McGlew and Tuttle, P.C.

(57) ABSTRACT

The invention relates to a method for introducing a material web into a corrugating device having a corrugating roller for generating from the material web a corrugated web. The method comprises the step of attaching at least one double-sided adhesive tape piece which has a first adhesive face and a second adhesive face that is opposite the first adhesive face to the material web by means of the first adhesive face upstream of the corrugating device of the material web, and guiding the material web through the corrugating device in such a manner that the second adhesive face adheres to the rotating corrugating roller while entraining the material web for introducing the material web.

19 Claims, 8 Drawing Sheets

METHOD FOR INTRODUCING A MATERIAL WEB INTO A CORRUGATING DEVICE

CROSS-REFERENCE TO RELATED APPLICATIONS

This application claims the priority of German Patent Application, Serial No. DE 10 2018 214 853.8, filed on Aug. 31, 2018, pursuant to 35 U.S.C. 119(a)-(d), the content of which is incorporated herein by reference in its entirety as if fully set forth herein.

FIELD OF THE INVENTION

The invention relates to a method for introducing a material web into a corrugating device for generating from the material web a corrugated web. The invention furthermore relates to a corrugated paperboard assembly having a corrugating device for generating from a material web a corrugated web.

BACKGROUND OF THE INVENTION

Corrugating devices for generating from smooth material webs corrugated webs are generally known from the prior art on account of the obvious prior use. The introduction of a material web into the corrugating device is often time-intensive or difficult, respectively. The reintroduction of the material web into the corrugating device is necessary after a replacement of the corrugating device, for example.

SUMMARY OF THE INVENTION

The invention is based on the object of providing a method for introducing a material web into it corrugating device which is particularly functionally reliable, on the one hand, and is extremely simple, on the other hand. Furthermore, a corrugated paperboard assembly which permits introducing a material web into a corrugating device in a particularly functionally reliable and extremely simple manner is to be provided.

This object is achieved according to the invention by a method for introducing a material web into a corrugating device having a corrugating roller for generating from the material web a corrugated web having a corrugation, comprising the steps of attaching at least one double-sided adhesive tape piece which has a first adhesive face and a second adhesive face that is opposite the first adhesive face to the material web by means of the first adhesive face upstream of the corrugating device in terms of a transportation direction of the material web, and guiding the material web through the corrugating device in such a manner that the second adhesive face adheres to the rotating corrugating roller while entraining the material web for introducing the material web.

According to a second aspect of the invention, this object is achieved by a corrugated paperboard assembly, having a corrugating device having a corrugating roller for generating from a material web a corrugated web having a corrugation, wherein at least one double-sided adhesive tape piece which has a first adhesive face and a second adhesive face that is opposite the first adhesive face for introducing the material web into the corrugating device is attached to the material web by means of the first adhesive face and by means of the second adhesive face adheres to the rotating corrugating roller while entraining the material web for introducing the material web. The core concept of the invention lies in a double-sided or both-sided, respectively, adhesive tape piece or adhesive tape, respectively, which for introducing or threading, respectively, the material web into a corrugating device by way of the first adhesive face of said adhesive tape piece adheres to the material web, on the one hand, and when or after, respectively, being guided through the corrugating device by way of the second adhesive face of said adhesive tape piece adheres, in particular circumferentially, to the corrugating roller, on the other hand, and is thus entrained by the rotating corrugating roller which thus also leads to a corresponding entrainment of the material web.

The material web herein is deflected by the rotating corrugating roller. The corrugating roller when introducing the material web into the corrugating device favorably rotates about the rotation axis of said corrugating roller. The corrugating roller preferably rotates about said rotation axis also in the actual corrugating procedure.

The material web is favorably originally smooth. For example, said material web is composed of cellulose, or paperboard or paper, respectively. It is advantageous for the material web to be continuous and single-ply.

It is expedient for the corrugating device to have at least one counter element which is assigned to the corrugating roller, and conjointly with the latter configures a corrugating gap for corrugating the material web while generating the corrugated web. It is advantageous for the counter element to be embodied as a further corrugating roller.

The at least one adhesive tape piece is disposed on the material web in such a manner that the second adhesive face of said adhesive tape piece faces away from the material web and the material web when/after being guided through the corrugating device faces the corrugating roller, or bears, in particular in an adhesive manner, on said corrugating roller, respectively. The first adhesive face when the material web is being guided through the corrugating device faces away from the corrugating roller that deflects the material web.

The attaching of the at least one adhesive tape piece is favorably performed so as to be spaced apart from the corrugating device such that an adhesive tape piece reserve remains, in particular thermally, uncompromised by the active corrugating device.

It is expedient for the at least one adhesive tape piece to be attached to the material web in a central region in terms of a transverse direction of the material web. The at least one adhesive tape piece is favorably disposed in a region that at least later is a trailing or leading region, respectively, of the material web.

It is expedient for the at least one adhesive tape piece to be of a label type. Finished adhesive tape pieces or adhesive labels, respectively, are preferably provided and used particularly in an uncut manner.

Alternatively, the at least one adhesive tape piece emanates from a flexural adhesive tape strip. In this instance, an adhesive-tape separating device is favorably present.

It is advantageous for a first adhesive, or a first adhesive compound, respectively, while forming a first adhesive face to be disposed in particular in the manner of a layer on an adhesive tier, or film, said first adhesive face preferably being composed of a thermoplastic elastomer such as polyester, in particular, none-reinforced copolyester and/or polyurethane. The adhesive tier or film, respectively, preferably forms a carrier medium. The latter preferably has or carries, respectively, a second adhesive or a second adhesive compound, respectively. The first adhesive or the first adhesive compound, respectively, can be present in the form of a film. It is expedient for the second adhesive face to be configured on the adhesive tier or film, respectively. The first adhesive face, at least originally, is preferably covered by a removable release cover which is composed of silicone, for example, or is provided with a silicone coating. The adhesive faces favorably face away from one another.

The adhesive that configures the first adhesive face is preferably (self-) adhesive or adherent, respectively, at room temperature, that is to say without a separate thermal influence or a separate thermal input, respectively. The adhesives or adhesive compounds, respectively, of the at least one adhesive tape piece used favorably differ from one another, in particular in terms of the manner of adhesion or composition, respectively.

A glue application device for applying glue to peaks of the corrugation of the corrugated web is preferably present downstream of the corrugating device in terms of the transportation direction of the material web.

It is advantageous for a pressing device for pressing a cover web onto the peaks of the corrugated web that are provided with glue to be provided downstream of the glue application device.

The corrugated paperboard assembly preferably comprises a separating device, having at least one separating installation for separating the material web, said separating installation being disposed upstream of the corrugating device.

The corrugated paperboard assembly for holding, in particular in a clamping manner, are separated trailing web portion of the material web favorably has a holding device that is disposed downstream of the separating installation, this simplifying the further handling. The holding device is preferably capable of holding the material web such that said material web in particular in a controlled manner tears, or is completely separated, respectively, when a tensile force is applied, for example, when starting up the corrugated paperboard assembly or line, respectively, starting up the corrugating device, and/or when replacing a corrugating device.

Upon complete severing of the material web, idling of the device for producing a corrugated paperboard web laminated on one side is preferably performed in the event of an onward transportation of a leading web portion of the material web generated on account of said complete severing.

It is expedient for the corrugated paperboard assembly to comprise a transport device for transporting the separated trailing web portion of the material web to the corrugating device. The transport device is preferably disposed between the separating installation and the corrugating device.

The corrugated paperboard assembly favorably comprises the device for producing a corrugated paperboard web laminated on one side which comprises the corrugated web.

The terms "upstream", "downstream", "disposed upstream", "disposed downstream", "leading", "trailing", or the like, used herein generally relate to the transportation direction of the respective web, in particular to the transportation direction of the (first) material web.

The second adhesive face configured on a hot-melt adhesive, or the second adhesive face fused by means of heat, preferably between 90° C. and 120° C., preferably between 100° C. and 110° C., is in particular not at all adherent or adhesive, respectively, at room temperature, or below the melting temperature of said adhesive, respectively. Activating is performed by a thermal input, or the input of heat, respectively. An adhesive tape piece of this type is releasable from the corrugating roller, in a particularly simple and residue-free manner. Fused liquid adhesive substantially penetrates only the material web. The adhesive connection of said adhesive to the corrugating roller, which preferably has a smooth corrugated external face, preferably from steel, is reduced in comparison to the adhesive effect in relation to the material web. The adhesive effect in the direction of the material web is greater.

The second adhesive face upon activation, or upon an adequate thermal input, respectively, favorably has or generates, respectively, a minimum adhesive force which is sufficient for holding the material web on the corrugating roller when introducing the material web into the corrugating device, in particular, despite counteracting (restoring) embossing forces and optionally gravity.

Alternatively, the second adhesive face, or the second adhesive, respectively, has a certain reduced, or slight, respectively, adhesive capability already at room temperature.

The corrugating roller having an external temperature, preferably between 140° C. and 180° C., preferably between 150° C. and 170° C., such that the second adhesive face is fused is heated in use, such as when introducing the material web into the corrugating device, or when corrugating, respectively, this simplifying the corrugating of the material web. The heating of the corrugating roller is preferably performed from the inside, for example by means of steam. On account of the contact between the material web and the corrugating roller, the former, and thus also the at least one adhesive tape piece that is attached to the material web, at least at the second adhesive face is heated to a temperature which is above the melting or activating, temperature, respectively, of the second adhesive face, or of the hot-melt adhesive, respectively.

The temporal interval between melting at least the second adhesive face, or the hot-melt adhesive, respectively, and the connecting of the latter to the corrugating roller is extremely short, this leading to a particularly reliable adhesive connection between the corrugating roller and the material web.

According to a preferred embodiment, the corrugating roller when introducing the material web into the corrugating device preferably rotates at the lowest circumferential or basic speed, respectively, of said corrugating roller, or at a reduced circumferential or basic speed, respectively, about the rotation axis of said corrugating roller, said circumferential speed amounting to between 1 m/min and 25 m/min, preferably between 5 m/min and 15 m/min. It is expedient for the at least one adhesive tape piece herein to bear on the corrugating roller for at least one second, this leading to a reliable adherence of the second adhesive face to said corrugating roller. On account of the generated pressure acting on the material web, or on the at least one adhesive tape piece, respectively, in the corrugating gap, the heat from the corrugating roller by way of the second adhesive face very rapidly penetrates the at least one adhesive tape piece, in particular the hot-melt adhesive. For example, the corrugating roller when introducing the material web rotates at six to nine revolutions per minute.

The design embodiment configured such that the at least one adhesive tape piece is attached to the material web upstream of at least one deflection roller in terms of the transportation direction of the material web leads to a disposal of an adhesive tape piece reserve that is spaced apart, in particular thermally protected, in relation to the corrugating device. Since the at least one deflection roller is favorably non-heated, the second adhesive face when configured on a hot-melt adhesive remains non-activated at said deflection roller, such that an adherence of the at least one adhesive tape piece to the at least one deflection roller is reliably prevented when transporting the material web over said deflection roller.

According to one preferred embodiment, the at least one adhesive tape piece is manually attached to the material web, thus attached by hand or by an operator, respectively.

Alternatively, according to another preferred embodiment, the at least one adhesive tape piece is attached to the material web in a mechanized or automated manner, respectively. In this instance, a replacement or change over, respectively, of the corrugating roller, or of the entire corrugating device, respectively, is preferably possible in a fully automatic manner.

The pressing installation for pressing the at least one adhesive tape piece onto the material web ensures a reliable disposal of the at least one adhesive tape piece to the material web by means of the first adhesive face. To this end, said pressing installation comprises, for example, at least one pressing element which is preferably repositionable between an inactive position and a pressing position. The at least one pressing element is preferably embodied as a pressing roll or a pressing block.

The method configured such that the material web conjointly with the at least one adhesive tape piece when introducing the material web into the corrugating device is entrained over an angular range between 160° and 270° about a rotation axis of the corrugating roller leads to an introduction procedure of the material web into the corrugating device that is extremely functionally reliable. It is thus in particular avoidable that the material web winds itself onto the rotating corrugating roller. The release of the material web from the corrugating roller is performed in a manual or mechanized manner.

It is expedient for the material web, in particular, proceeding from a corrugating gap, to be entrained by the corrugating roller over an angular range of at least 160° about a rotation axis/central axis of the corrugating roller. The angular range is preferably less than 300°, preferably less than 270°. The material web preferably adheres to the corrugating roller only temporarily, or when threading, respectively.

In the case of the method configured such that the material web when introducing the material web into the corrugating device, downstream of a glue gap for gluing the material web and of a pressing gap for pressing the material web provided with glue and a further material web on each other, while forming a corrugated paperboard web laminated on one side, is removed from the corrugating roller by means of the discharged further material web, the material web, downstream of the pressing gap which is formed between a pressing device and the corrugating roller in relation a to transportation direction of the material web, by means of the further material web which in the pressing gap is non-releasably adhesively bonded to the material web and is preferably embodied as a smooth web, is conjointly pulled into an overhead transport device and is thus automatically removed from the corrugating roller. A connecting force, or adhesive-bonding force, respectively, prevailing between the material webs is greater than a connecting force, or adhesive-bonding force, respectively, prevailing between the corrugating roller and the at least one adhesive tape piece.

According to one preferred embodiment, it is expedient for the second adhesive face, upon activation or a sufficient thermal input, respectively, to generate or have, respectively, a maximum adhesive force which is less than an adhesive force prevailing between an in particular smooth cover web, or further material web, respectively, that is adhesively bonded or glued, respectively, to the, in particular corrugated, material web that carries the at least one adhesive tape piece, so as to guarantee, for example, a reliable release, in particular in a manual or mechanized manner, of the material web that carries the at least one adhesive tape piece from the first corrugating roller after said material web is introduced into the corrugating device. The second adhesive face permits a reliable release of the at least one adhesive tape piece, or of the material web carrying the latter, respectively, from the first corrugating roller.

The two material webs are adhesively bonded to one another more strongly than the material web carrying the at least one adhesive tape piece, or the second adhesive face, respectively, is adhesively bonded to the first corrugating roller. The further material web thus is adhesively bonded more strongly to the corrugated material web than the latter is adhesively bonded to the first corrugating roller, this permitting the corrugated material web carrying the at least one adhesive tape piece to be torn away in a simple manner from the first corrugating roller by means of the further material web.

Two preferred embodiments of the invention will be described in an exemplary manner hereunder with reference to the appended drawing.

DESCRIPTION OF THE PREFERRED EMBODIMENT

Figure 1:
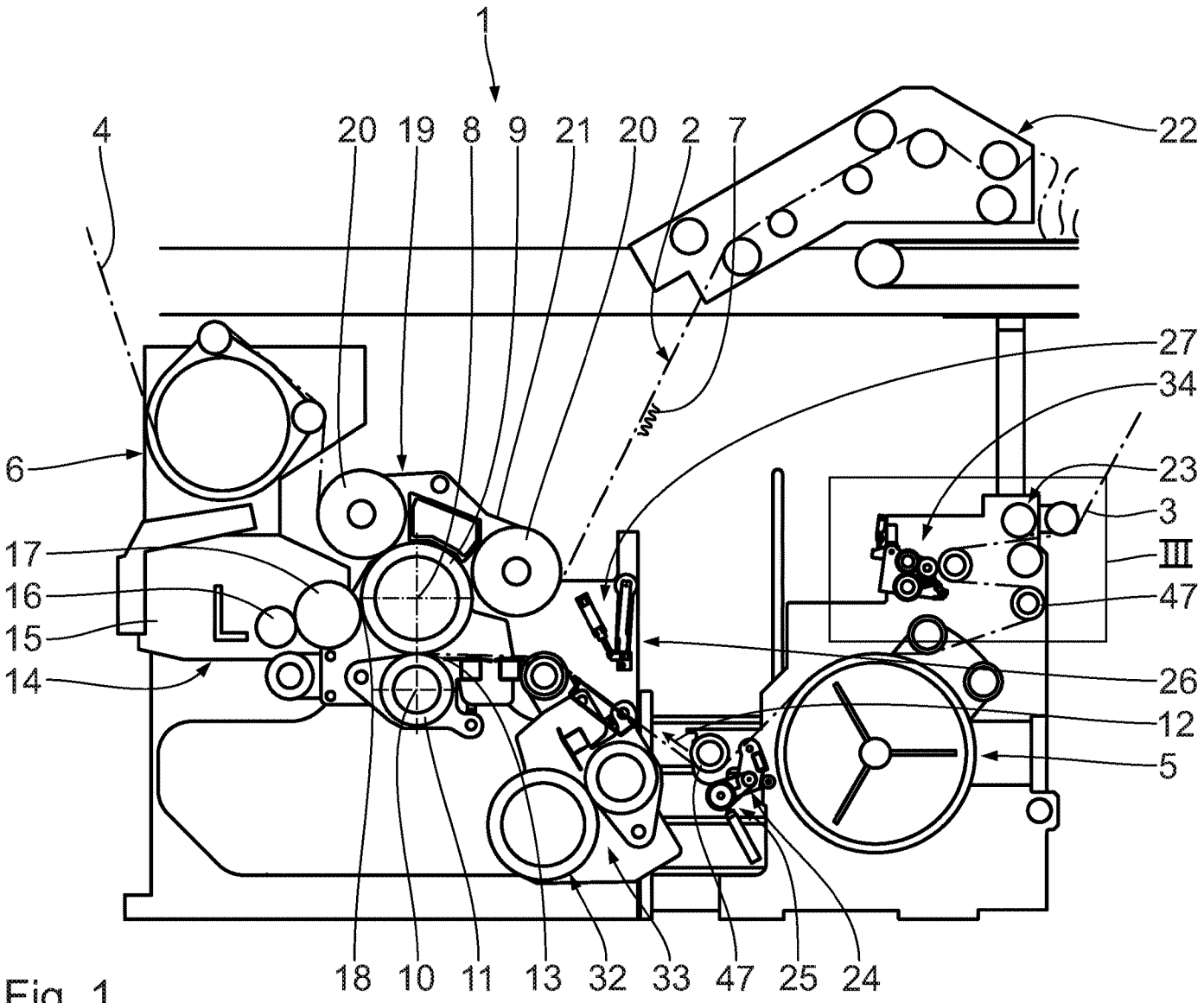
FIG. 1 shows a simplified lateral view of a corrugated paperboard assembly according to the invention, in which the method according to the invention is used.
Figure 2:
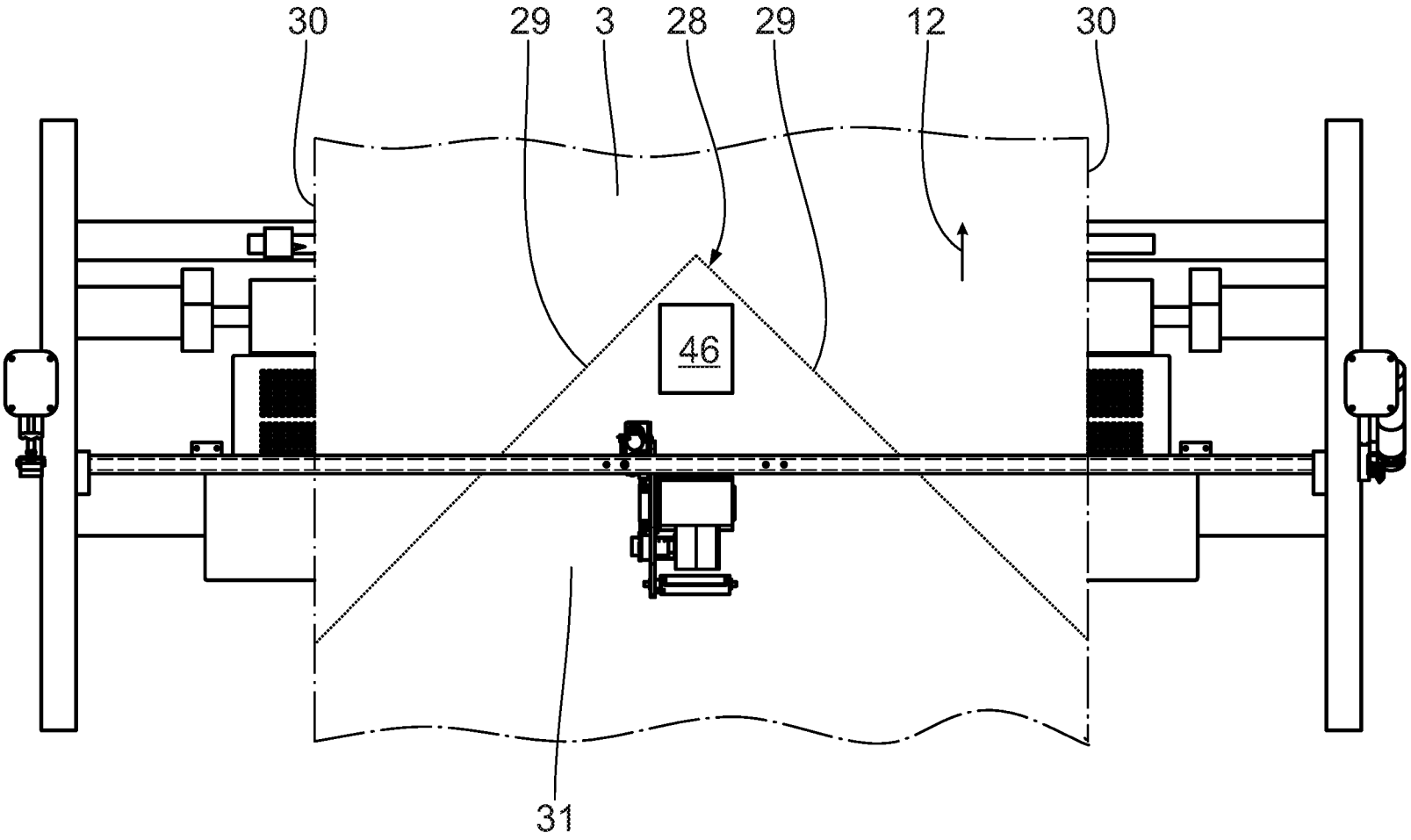
FIG. 2 shows a partial plan view of the corrugated paperboard assembly shown in FIG. 1, illustrating a material web being introduced into a corrugating device.

A device 1, shown in FIG. 1, for producing a corrugated paperboard web 2 laminated on one side, as a component part of a corrugated paperboard assembly or a corrugated paperboard line, respectively, is disposed downstream of a first unrolling device (not illustrated) and a second unrolling device (not illustrated) which are configured as a first and a second splicing device, respectively. The first splicing device for unrolling a finite first material web from a first material web roll comprises a first unrolling unit, and for unrolling a finite second material web from a second material web roll comprises a second unrolling unit. The finite first material web and the finite second material web for providing a continuous first material web 3 are connected to one another by means of a connecting and cutting unit of the first splicing device.

The second splicing device is embodied so as to correspond to the first splicing device. Said splicing device for unrolling a finite third material web from a third material web roll comprises a third unrolling unit, and for unrolling a finite fourth material web from a fourth material web roll comprises a fourth unrolling unit. The finite third material web and the finite fourth material web for providing a continuous second material web 4 are connected to one another by means of a connecting and cutting unit of the second splicing device.

The continuous first material web 3 by way of a first pre-heating device 5 is supplied to the device 1 for producing a corrugated paperboard web 2 laminated on one side. The continuous second material web 4 by way of a second pre-heating device 6 is supplied to the device 1 for producing a corrugated paperboard web 2 laminated on one side.

The device 1 for producing a corrugated paperboard web 2 laminated on one side, for generating from the continuous first material web 3 a continuous corrugated web 7 having a corrugation, comprises a first corrugating roller 9 that is mounted so as to be rotatable about a first rotation axis 8, and a second corrugating roller 11 that is mounted so as to be rotatable about a second rotation axis 10. The rotation axes 8, 10, run so as to be mutually parallel and perpendicular to a transportation direction, 12 of the continuous first material web 3. The corrugating rollers 9, 11 conjointly form a corrugating device. Said corrugating rollers 9, 11 delimit a corrugating gap 13 for guiding through and corrugating the first material web 3.

In order for the continuous corrugated web 7 to be connected to the continuous second material web 4 so as to form the continuous corrugated paperboard web 2 laminated on one side, the device 1 for producing a corrugated paperboard web 2 laminated on one side, downstream of the corrugating gap 13 in terms of the transportation direction 12 of the continuous first material web 3, has a glue application device 14. The glue application device 14 has a glue container 15, a glue metering roller 16 disposed in the glue container 15, and a glue application roller 17 disposed in the glue container 15. The glue metering roller 16 and the glue application roller 17 are rotatably mounted about corresponding rotation axes that run so as to be mutually parallel. The glue metering roller 16 is favorably embodied as a glue-squeezing roller.

The glue application roller 17 conjointly with the first corrugating roller 9 configures a gluing gap 18 for guiding through and gluing the corrugated web 7. Glue that is situated in the glue container 15 by way of the glue application roller 17 that is submerged in said glue is applied to free peaks of the corrugation of the transported corrugated web 7. The glue metering roller 16 is disposed so as to be substantially opposite the first corrugating roller 9, and so as to be adjacent to the glue application roller 17 and serves for configuring a uniform glue layer on the glue application roller 17.

The corrugated web 7 provided with glue is subsequently joined together with the transported second material web 4 in the device 1 for producing a corrugated paperboard web 2 laminated on one side, so as to generate the corrugated paperboard web 2 laminated on one side. The device 1 for producing a corrugated paperboard web 2 laminated on one side, has a contact pressure belt module 19 for pressing the continuous second material web 4 against the corrugated web 7 provided with glue, said corrugated web 7 in regions bearing on the first corrugating roller 9. The contact pressure belt module 19 in terms of the transportation direction 12 of the corrugated web 7 is disposed downstream of the glue application device 14. Said contact pressure belt module 19 is disposed above the first corrugating roller 9. The contact pressure belt module 19 has two rotatably mounted deflection rollers 20 and one continuous drivable contact pressure belt 21 that is guided around the deflection roller 20.

The first corrugating roller 9 in regions engages in a space present between the deflection rollers 20, on account of which the contact pressure belt 21 is deflected. The contact pressure belt 21 presses against the continuous second material web 4 which in turn is thus pressed against the corrugated web 7 which is provided with glue and bears on the first corrugating roller 9.

The corrugated paperboard web 2 laminated on one side, by way of an overhead transport device 22, is then supplied to a storage device (not illustrated) for temporarily storing and buffering.

The corrugated paperboard web 2 laminated on one side, in a connecting device (not illustrated) of the corrugated paperboard line downstream of the storage device, is subsequently connected, for example, to a lamination web (not illustrated) so as to form a corrugated paperboard web laminated on both sides (not illustrated) or connected to a further corrugated paperboard web laminated on one side and to a lamination web so as to form a five-ply corrugated paperboard web. The connecting device is preferably embodied as a heating/stretching section.

A longitudinal cutting/grooving device (not illustrated) for grooving and longitudinally cutting the corrugated paperboard web into corrugated paperboard part-webs, and a transverse cutting device (not illustrated) for transversely cutting the corrugated paperboard part-webs into corrugated paperboard sheets, and a stacking device (not illustrated) for stacking the corrugated paperboard sheets in stacks are disposed downstream of the connecting device, for example.

The corrugated paperboard assembly, upstream of the first pre-heating device 5 in terms of the transportation direction 12 of the first material web 3, has a separating installation 23 which is assigned to the first material web 3 and is capable of perforating the latter for a later complete separation across the transverse direction of said material web 3.

The separating installation 23 comprises a rotatably drivable rotary punch and a counter roller assigned to the latter, said counter roller favorably be coated with rubber. The rotary punch and the counter roller preferably extend perpendicularly to the transportation direction 12 of the continuous first material web 3. The continuous first material web 3 runs between the rotary punch and the counter roller.

The rotary punch and the counter roller are capable of generating a V-shaped perforation 28 in the continuous first material web 3, said V-shaped perforation 28 extending across the entire width of the continuous first material web 3. The V-shaped perforation 28 is formed by two oblique perforations 29 which, while forming an introduction tip 31, in the transportation direction 12 converge in an oblique manner from a respective longitudinal periphery 30 of the continuous first material web 3. The continuous first material web 3 herein, despite the V-shaped perforation 28, initially remains continuous or contiguous, respectively.

In order for the V-shaped perforation 28 to be generated, the counter roller moves towards the rotary punch. The rotary punch, while generating the V-shaped perforation 28, begins to rotate about the central axis of said rotary punch. Said rotary punch comprises projecting perforating members which are disposed in a corresponding manner and which then at least partially penetrate the continuous first material web 3 and are preferably disposed so as to be mutually spaced apart.

The separating installation 23 alternatively comprises two separating elements or perforating elements (not illustrated), respectively, which are repositionable, in particular in a synchronous manner, along a guide. The guide in a transverse direction of the continuous first material web 3 that runs perpendicularly to the transportation direction 12 extends across the entire continuous first material web 3. The separating elements are thus repositionable in the transverse direction of the continuous first material web 3. Said separating elements are repositionable between a separating position and an inactive parking position. The separating elements, on account of being repositioned in the transverse direction of the first material web 3, in the separating position are capable of generating the V-shaped perforation 28 in the transported continuous first material web 3. The separating elements in the separating position thereof are repositioned laterally from the outside towards one another across the entire continuous first material web 3 in the transverse direction of the continuous first material web 3, or are repositioned laterally from the inside towards the outside, while generating the V-shaped perforation 28 in the continuous first material web 3.

The corrugated paperboard assembly moreover comprises a first holding installation 24 and a first transporting installation 25 which both are disposed downstream of the separating installation 23 in terms of the transportation direction 12 of the continuous first material web 3 and are assigned to the continuous first material web 3. The first holding installation 24 and the first transporting installation 25 are disposed upstream of the corrugating device. Said holding installation 24 and said first transporting installation 25 form a first holding/transporting unit.

The corrugated paperboard assembly furthermore has a second holding installation 26 and a second transporting installation 27 which both are disposed downstream of the first holding installation 24 and the first transporting installation 25, respectively, in terms of the transportation direction 12 of the continuous first material web 3 and are assigned to the continuous first material web 3. The second holding installation 26 and the second transporting installation 27 are disposed upstream of the corrugating device. Said second holding installation 26 and said second transporting installation 27 form a second holding/transporting unit.

The holding installations 24, 26 form a holding device. The transporting installations 25, 27 form a transporting device.

The first holding/transporting unit and the second holding/transporting unit are disposed so as to be mutually spaced apart in the transportation direction 12 of the continuous first material web 3 and are favorably activatable in a mutually independent manner. Said first holding/transporting unit and said second holding/transporting unit are capable of holding the first material web 3, or a web portion of the latter, respectively, and/or of transporting said first material web 3, or a web portion of the latter, respectively, in the transportation direction 12. When being held, the first material web 3 is in regions substantially locationally fixed or stopped, respectively, while said material web 3 when being transported is transported in a guided manner at a transportation speed in the transportation direction 12.

The corrugated paperboard assembly moreover has a corrugating-device change over device 32 which stores a previously inactive corrugating device 33. The corrugating-device change over device 32 is disposed substantially between the separating installation 23 and the glue application device 14. Said corrugating-device change over device 32 is capable of replacing the previously active corrugating device with the previously inactive corrugating device 33. The previously inactive corrugating device 33 also has two corrugating rollers for corrugating the continuous first material web 3. As opposed to the previously used corrugating device, the previously inactive corrugating device 33 in terms of the corrugation of the latter differs from the previously used corrugation, for example.

The corrugated paperboard assembly moreover has an adhesive tape piece attachment device 34 which is disposed between the separating installation 23 and the first preheating device 5 and is assigned to the continuous first material web 3. The adhesive tape piece attachment device 34 is thus disposed upstream of the active corrugating device.

The adhesive tape piece attachment device 34 comprises an adhesive tape piece storage roll 35 which stores a tape 36 having double-sided or both-sided, respectively, adhesive tape pieces 46 and is rotatably mounted. The tape 36 has a multiplicity of label-type adhesive tape pieces 46 which are disposed in a row.

The adhesive tape piece attachment device 34 moreover has a in adhesive tape piece pressing roll 37 which in an unwinding direction 38 of the tape 36 is disposed downstream of the adhesive tape piece storage roll 35 and is rotatably mounted.

The adhesive tape piece attachment device 34 between the adhesive tape piece storage roll 35 and the adhesive tape piece pressing roll 37 comprises a separation wedge 39. The separation wedge 39 is disposed so as to be adjacent to the adhesive tape piece pressing roll 37.

The adhesive tape piece attachment device 34 furthermore has an intermediate roll 55 which is rotatably mounted. The separation wedge 39 is disposed substantially between the intermediate roll 55 and adhesive tape piece pressing roll 37. A free wedge tip of the separation wedge 39 is directed substantially onto a counter roll 45 which is disposed so as to be adjacent and which guides and deflects the first continuous material web 3.

A release-cover winding roll 56 of the adhesive tape piece attachment device 34 is rotatably disposed so as to be adjacent to the intermediate roll 55. The release-cover winding roll 56 is disposed above the adhesive tape piece storage roll 35.

The adhesive tape piece storage roll 35, the adhesive tape piece pressing roll 37, the intermediate roll 55, and the release-cover winding roll 56 have rotation axes which run so as to be mutually parallel and perpendicular to the transportation direction 12 of the continuous first material web 3. The adhesive tape piece storage roll 35, the adhesive tape piece pressing roll 37, the separation wedge 39, the intermediate roll 55, and the release-cover winding roll 56 are disposed on a support frame 40 which by means of a pivoting actuator 41 is pivotable about a horizontal pivot axis 42. The pivoting actuator 41 has a housing 43 which is connected to a frame of the corrugated paperboard assembly, and a piston rod 44 which is axially repositionable and guided in said housing 43. The piston rod 44 engages on the support frame 40. In particular, the adhesive tape piece pressing roll 37 is thus pivotable between a pressing position and a resting position, and the intermediate roll 55, conjointly with said adhesive tape piece pressing roll 37, is pivotable between a driving position and arresting position.

The adhesive tape piece pressing roll 37 is assigned the counter roll 45. The adhesive tape piece pressing roll 37 in the resting position is disposed so as to be spaced apart from the counter roll 45 (FIG. 3), while said adhesive tape piece pressing roll 37 in the pressing position bears on the continuous first material web 3 that there is guided around the counter roll 45, or on the attached adhesive tape piece 46 (FIG. 4).

Figure 3:
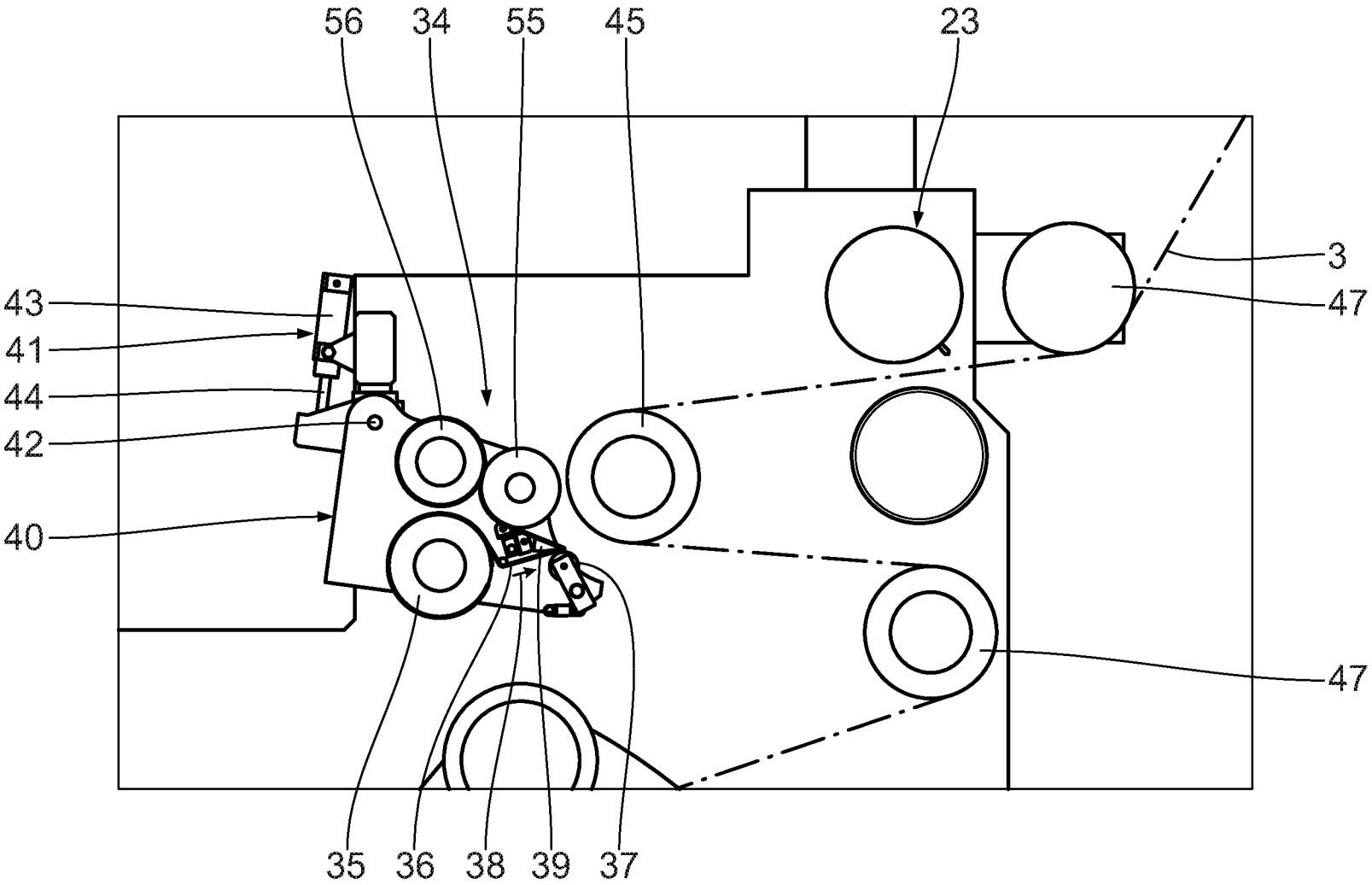
FIG. 3 shows the detail III identified in FIG. 1, which illustrates a preparation for introducing the material web into the corrugating device.
Figure 4:
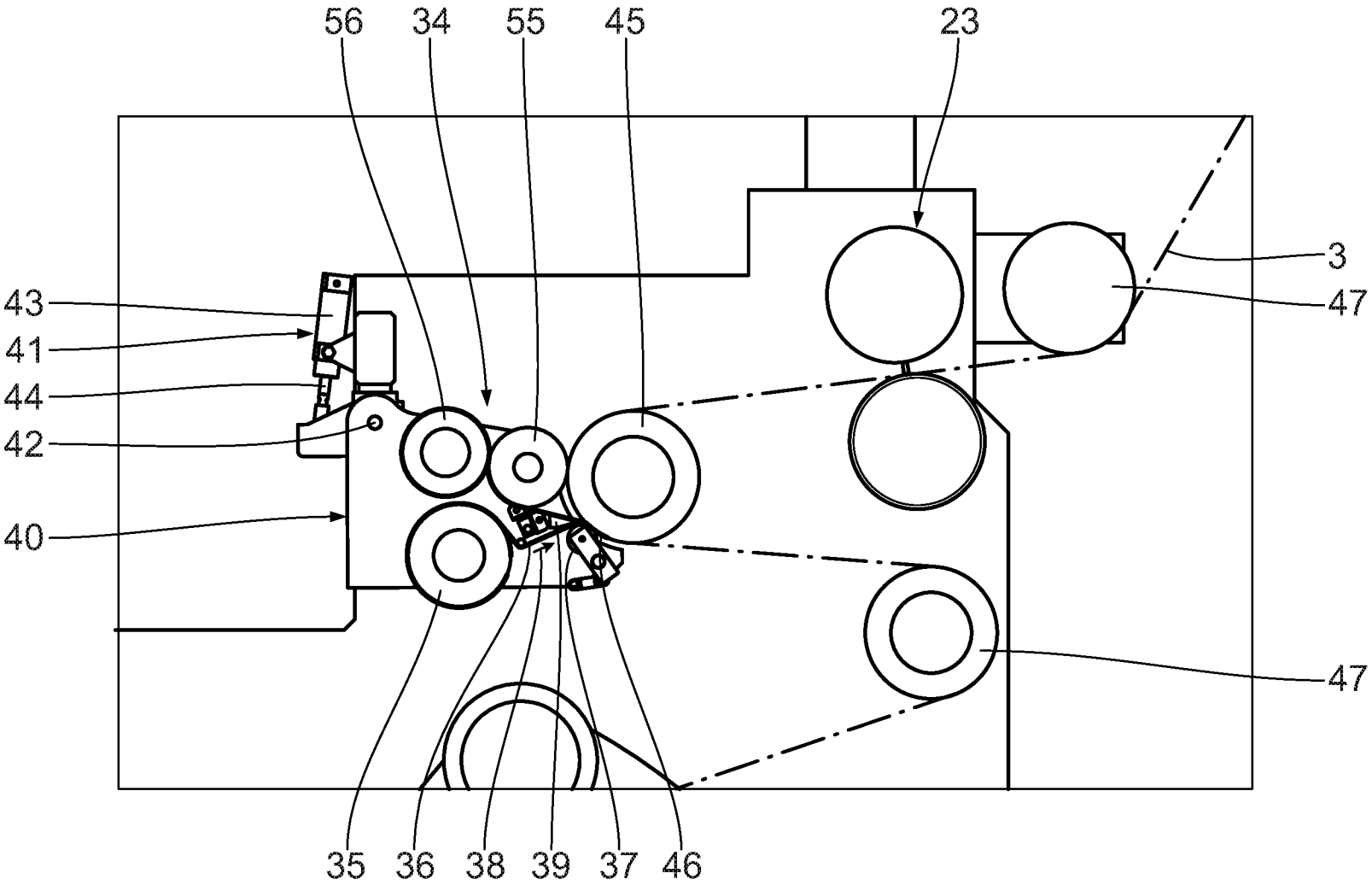
FIG. 4 shows a fragment corresponding to FIG. 3, wherein an adhesive-tape pressing installation is activated.
Figure 5:
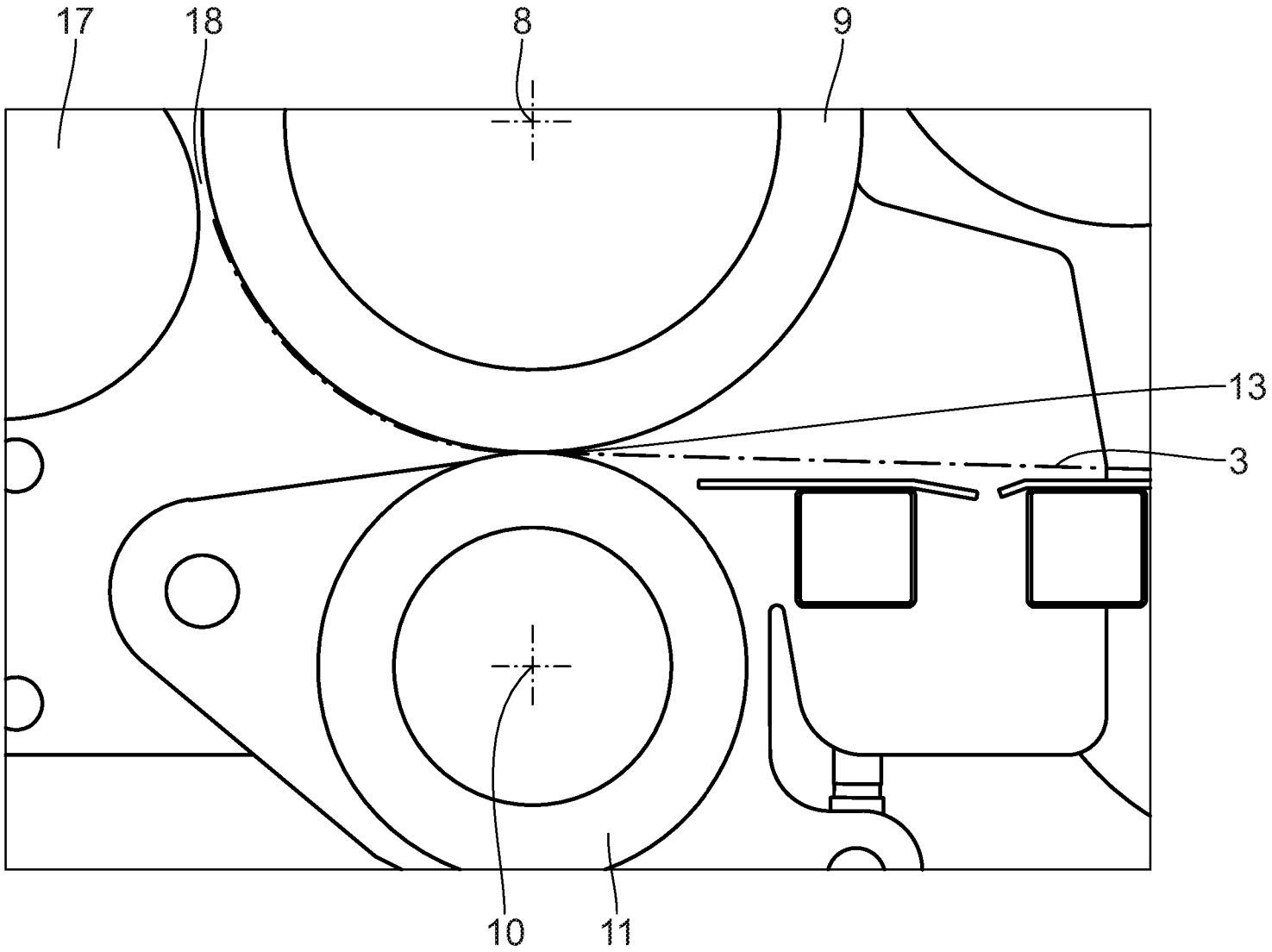
FIG. 5 shows a fragment corresponding to FIGS. 3, 4, which illustrates an adherence of the material web to the corrugating roller.

The intermediate roll 55 in the resting position is disposed so as to be spaced apart from the counter roll 45 (FIG. 3). Said intermediate roll 55 in the driving position circumferentially bears on the continuous first material web 3 that there is guided around the counter roll 45 (FIG. 4).

The first material web 3 from the adhesive tape piece attachment device 34 is guided by way of a plurality of deflection rolls 47 to the active corrugating device.

In the normal operation of the corrugated paperboard assembly or line, respectively, the continuous first material web 3 runs past the separating installation 23. The separating installation 23 herein is inactive and does not act in a separating or perforating manner, respectively, on the continuous first material web 3. Furthermore, the continuous first material web 3 passes the first and the second holding/transporting unit, both being inactive and not acting on the continuous first material web 3.

The second corrugating device 33 is in the inactive parking position thereof. The continuous first material web 3 is corrugated by the corrugating rollers 9, 11 and is glued by the glue application device 14. The continuous second material web 4 is connected to the continuous first material web 3 while forming the corrugated paperboard web 2 laminated on one side.

For example, when a production order has been completed and a new production order having another fluting or corrugated web corrugation, respectively, is present a replacement of the previously active corrugating device by the previously inactive parked corrugating device 33 is performed.

To this end, the V-shaped perforation 28 is then generated in the continuous first material web 3 by means of the separating installation 23.

In terms of the transportation direction 12 of the first material web 3, a downstream/leading web portion of the continuous first material web 3 is present downstream of the V-shaped perforation 28, and an upstream/trailing web portion of the continuous first material web 3 is present upstream of said V-shaped perforation 28.

The first holding/transporting unit and the second holding/transporting unit are activated. Said holding/transporting units are repositioned from the respective inactive positions thereof. Said holding/transporting units fix the upstream or trailing, respectively, web portion of the continuous first material web 3 in relation to the V-shaped perforation 28. Said holding/transporting units are then situated in the respective holding positions thereof.

The previously active corrugating device transports the first material web 3 onwards such that the latter, while forming the free introduction tip 31, tears along the perforation 28 that has previously been incorporated in the first material web 3. The corrugating device is a component part of the separating device.

The downstream or leading, respectively, web portion of the first material web 3 that is created on account of the tearing of the first material web 3 is conveyed out of the device 1 for producing a corrugated paperboard web 2 laminated on one side, while the upstream or trailing, respectively, web portion is held by the holding/transporting units.

The previously active corrugating device is then pivoted in the direction towards the parking position thereof. By contrast, the previously inactive corrugating device 33 is pivoted out of the previous parking position thereof in the direction towards the active corrugating position of said corrugating device 33. A separation of the first material web 3 along the perforation 28 can also be alternatively performed herein.

The adhesive tape piece attachment device 34 attaches an adhesive tape piece 46 onto the first material web 3 in the introduction tip 31 of the latter.

The adhesive tape piece 46 to be attached is supplied from the adhesive tape piece storage roll 35 to the adhesive tape piece pressing roll 37. Said adhesive tape piece 46 when being transferred to the continuous first material web 3 is situated circumferentially on the adhesive tape piece pressing roll 37 so as to be opposite the counter roll 45.

For attaching the adhesive tape piece 46 to the continuous first material web 3, the intermediate roll 55 by actuating the pivoting actuator 41 is repositioned in the direction towards the counter roll 45, or in the direction towards the first material web 3 that bears on said counter roll 45, respectively. The intermediate roll 55 is pivoted to the driving position thereof. In the driving position, the intermediate roll 55 in the region of the counter roll 45 bears on the transported first material web 3, on account of which the intermediate roll 55 and thus the release-cover winding roll 56 are set in rotation.

The release cover 51 is guided through between the intermediate roll 55 and the release-cover winding roll 56 that is disposed so as to be adjacent to said intermediate roll 55 and is guided to the release-cover winding roll 56.

On account of the release cover 51 being wound onto the rotating release-cover winding roll 56, the release cover 51 by way of the separation wedge 39 is pulled from the adhesive tape piece supply roll 35. The free wedge tip of the separation wedge 39 separates the adhesive tape piece 46 from the release cover 51, said adhesive tape piece 46 in regions projecting from the release cover 51. The adhesive tape piece 46 in the region of the wedge tip of the separation wedge 39 comes into contact with the transported first material web 3 and adheres to the latter.

For reliable adherence, the adhesive tape piece pressing roll 37 firmly presses the adhesive tape piece 46 onto the transported continuous first material web 3. The adhesive tape piece pressing roll 37 by activating the pivoting actuator 41 has been repositioned in the direction towards the counter roll 45, or in the direction towards the first material web 3 that bears on the latter, respectively. The adhesive tape piece pressing roller 37 is pivoted to the pressing position thereof.

When the adhesive tape piece attachment device 34 is active, the continuous first material web 3 is guided through successively disposed gaps between the counter roll 45 and the intermediate roll 55 and between the counter roll 45 and the adhesive tape piece pressing roll 37. In terms of the transportation direction 12 of the continuous first material web 3, the gap between the counter roll 45 and the intermediate roll 55 is disposed upstream of the gap between the counter roll 45 and the adhesive tape piece pressing roll 37.

Figure 8:
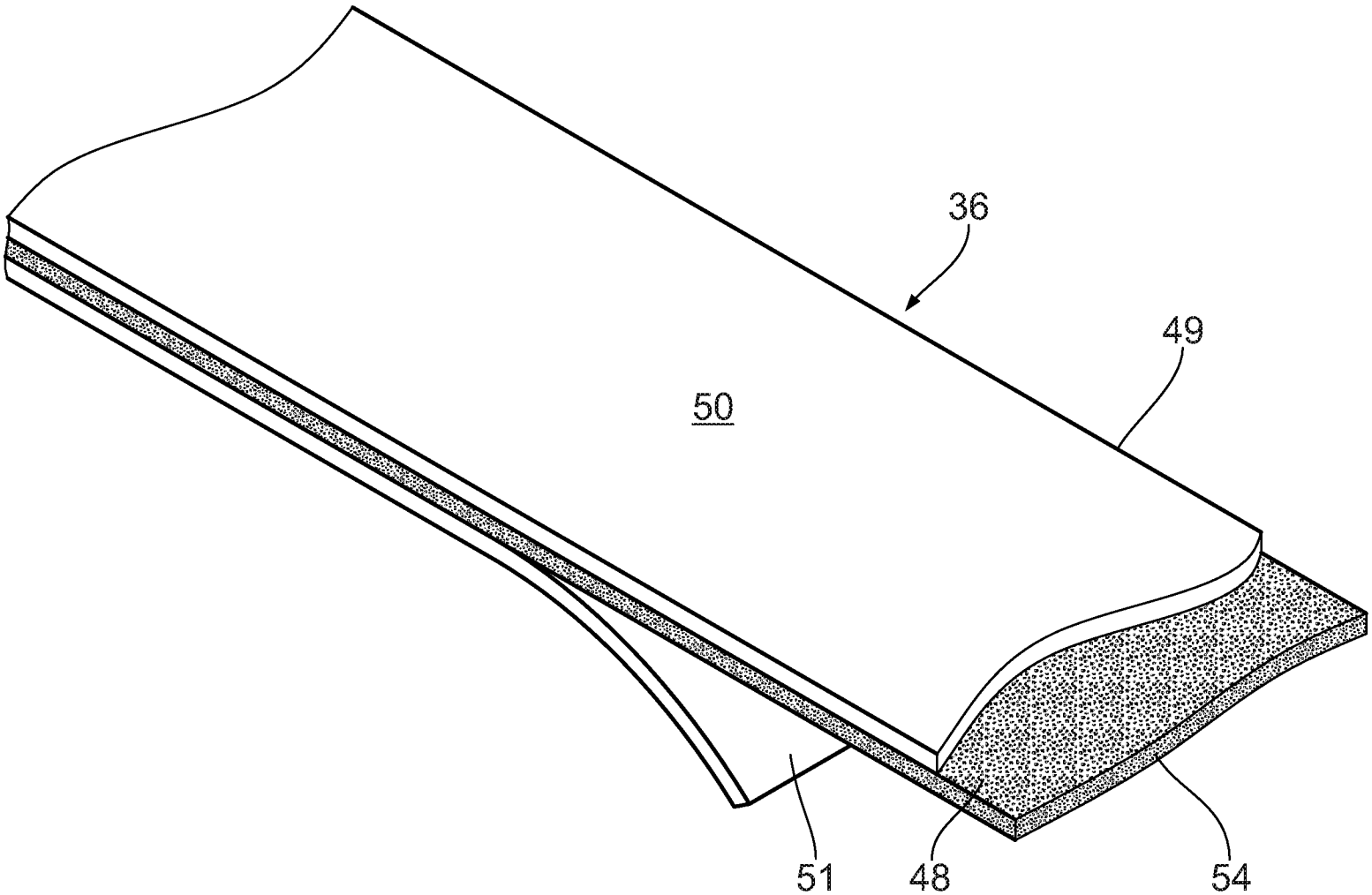
FIG. 8 shows a schematic view of a double-sided adhesive tape piece which is used in the corrugated paperboard assembly shown.

As is shown in FIG. 8, the adhesive tape piece 46 is double-sided. Said adhesive tape piece 46 comprises an adhesive film 49 on which an adhesive compound 54 while forming a first external adhesive face 48 is disposed in the manner of a layer, said adhesive compound 54 being effective at room temperature. A second external adhesive face 50 is configured on the adhesive film 49. The entire adhesive film 49 is formed from a hot-melt adhesive. The first adhesive face 48 is originally covered by a tape-type release cover 51 which is removable.

The second adhesive face 50 faces away from the first adhesive face 48. The adhesive film 49 and the adhesive compound 54 are disposed on top of one another, or cover one another. The adhesive tape piece 46 by way of the first adhesive face 48 thereof is connected to the continuous first material web 3 and is thus fixed thereon in an adhesive manner.

The upstream or trailing, respectively, web portion of the continuous first material web 3 on which the adhesive tape piece 46 is situated, by way of the leading or forward, respectively, introduction tip 31 is then transported into the active corrugating device by means of the then active holding/transporting units. The corrugating rollers 9, 11 rotate but at a circumferential speed of, for example, 10 m/min which is reduced in comparison to a normal corrugating operating speed. The adhesive film 49, at least in the case of the second adhesive face 50 thereof, fuses in the corrugating gap 13 and wets the continuous first material web 3 and the first corrugating roller 9. The adhesive film 49 becomes (viscous-) liquid and sticky at least in the case of the second adhesive face 50. After exiting the corrugating gap 13, the adhesive tape piece 46 that is fastened to the continuous first material web 3 adheres to the first corrugating roller 9 and is thus further heated. The external temperature of the first corrugating roller 9 is above the melting or activating temperature, respectively, of the second adhesive face 50. Since the adhesive tape piece 46 after passing through the corrugating gap 13 no longer has any contact with the second corrugating roller 11 and thus is imparted slight cooling/curing, an adhesive capability of the second adhesive face 50 increases at least somewhat. A complete adhesive effect or curing, respectively, of the second adhesive face 50 does not arise therein.

After an entrainment of the continuous first material web 3 about the first corrugating roller 9, or the first rotation axis 8, respectively, by an angular range between 160° and 270°, from the corrugating gap 13 or downstream of the contact pressure belt module 19, respectively, the adhesive tape piece 46, or the introduction tip 31, respectively, of the continuous first material web 3 is removed from the first corrugating roller 9 again. The continuous first material web 3 up to this separation point is transported through the glue gap 18 and the contact pressure belt module 19 on the first corrugating roller 9. The continuous first material web 3, downstream of the glue gap 18 and of the contact pressure belt module 19, is fixedly connected or adhesively bonded, respectively, in a planar manner to the continuous second material web 4.

By virtue of the corrugated paperboard web 2 laminated on one side being transported into the overhead transport device 22, the continuous first material web 3 is removed from the first corrugating roller 9. A manual removal is alternatively performed.

Figure 6:
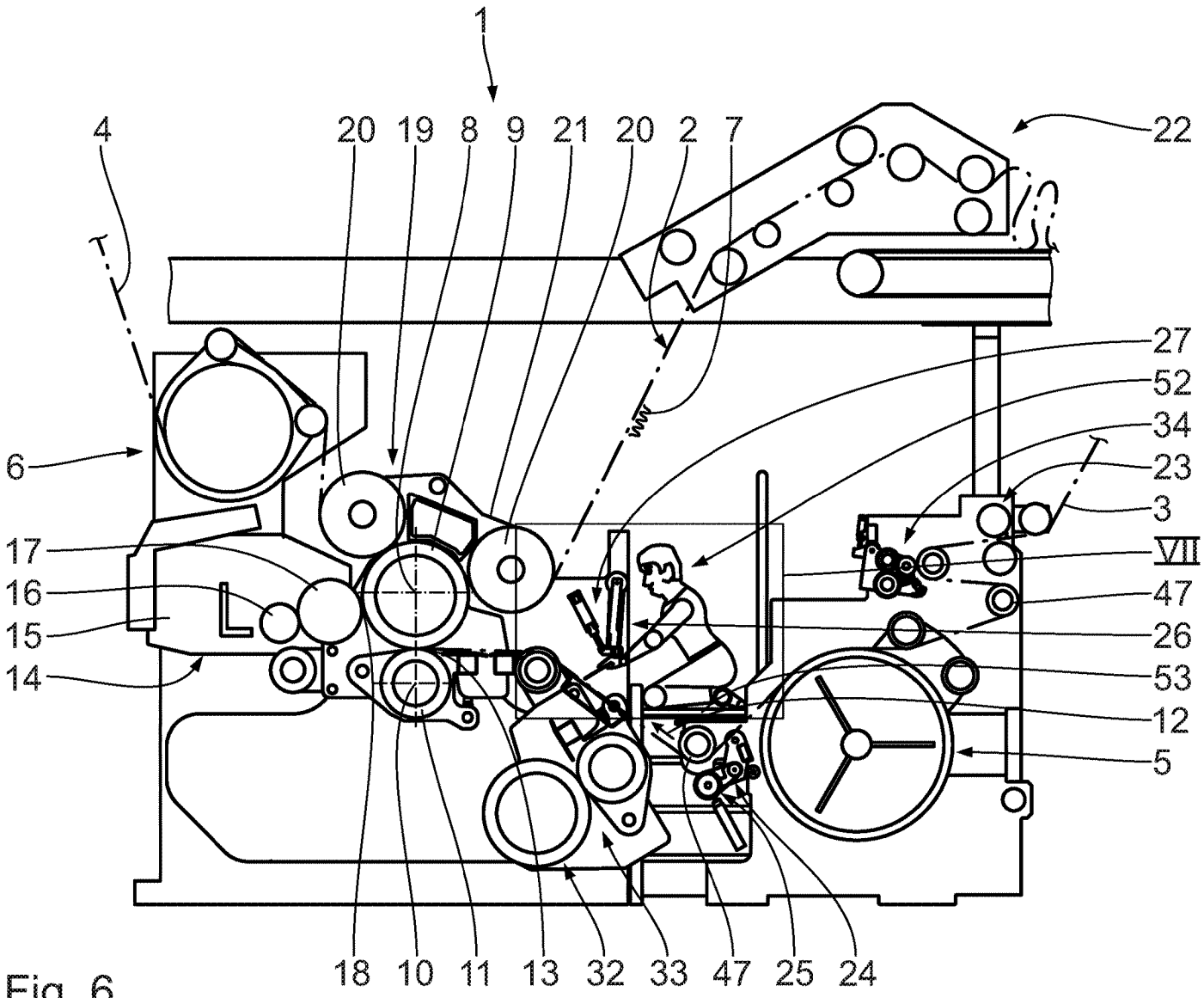
FIG. 6 shows a simplified lateral view of a corrugated paperboard assembly according to the invention, according to a second embodiment which utilizes the method according to the invention.
Figure 7:
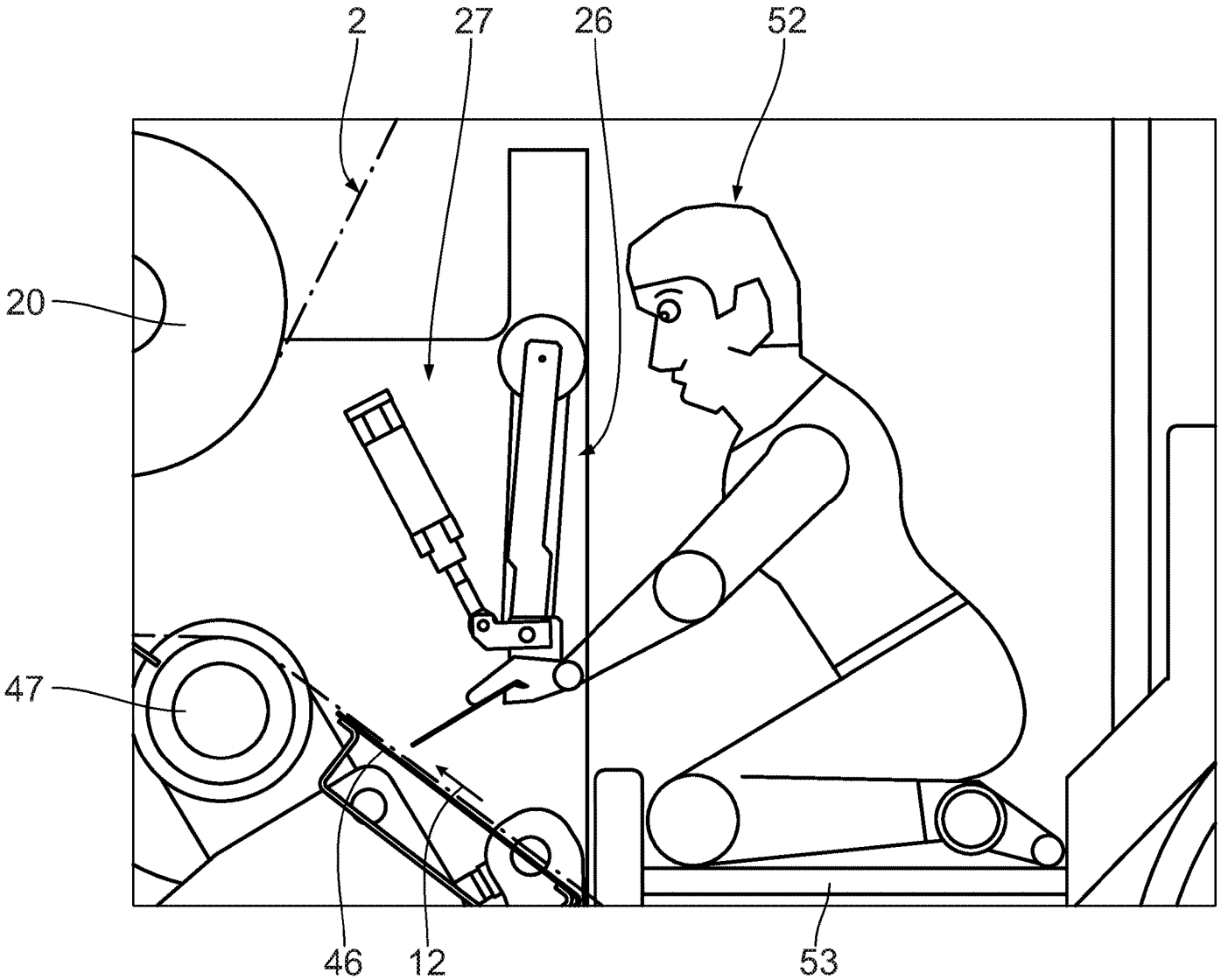
FIG. 7 shows the detail VII identified in FIG. 6 which illustrates a manual attachment of an adhesive tape piece.

An alternative embodiment will be described hereunder with reference to FIGS. 6, 7. Identical parts are identified by the same reference signs as in the preceding embodiment, the description thereof hereby explicitly being referred to.

In the case of this alternative embodiment, the adhesive tape attachment device 34 is absent. In a corresponding manner, an adhesive tape piece 46 is attached to the continuous first material web 3 upstream of the corrugating gap 13 and preferably downstream of the first pre-heating device 5, preferably between the holding/transporting units by a machine operator 52. To this end, a respective walkway 53 is favorably available to the machine operator 52.

What is claimed is:

1. A method for introducing a material web into a corrugating device having a corrugating roller for generating from the material web a corrugated web having a corrugation, the method comprising the steps:

attaching at least one double-sided adhesive tape piece which has a first adhesive face and a second adhesive face that is opposite the first adhesive face to the material web by means of the first adhesive face upstream of the corrugating device in terms of a transportation direction of the material web; and guiding the material web through the corrugating device in such a manner that the second adhesive face adheres to the rotating corrugating roller while entraining the material web for introducing the material web, wherein the second adhesive face is configured on a hot-melt adhesive.

2. The method according to claim 1, wherein the second adhesive face is fused by means of heat.

3. The method according to claim 2, wherein the temperature for fusing the second adhesive face is between 90° C. and 120° C.

4. The method according to claim 2, wherein the temperature for fusing the second adhesive face is between 100° C. and 110° C.

5. The method according to claim 1, wherein the corrugating roller has an external temperature such that the second adhesive face is fused.

6. The method according to claim 5, wherein the external temperature of the corrugating roller is between 140° C. and 180° C.

7. The method according to claim 5, wherein the external temperature of the corrugating roller is between 150° C. and 170° C.

8. The method according to claim 1, wherein the corrugating roller when introducing the material web rotates at a circumferential speed between 1 m/min and 25 m/min.

9. The method according to claim 8, wherein the corrugating roller when introducing the material web rotates at a circumferential speed between 5 m/min and 15 m/min.

10. The method according to claim 1, wherein the at least one adhesive tape piece is attached to the material web upstream of at least one deflection roller in terms of the transportation direction of the material web.

11. The method according to claim 1, wherein the at least one adhesive tape piece is manually attached to the material web.

12. The method according to claim 1, wherein the at least one adhesive tape piece is attached to the material web by means of an attaching device.

13. The method according to claim 12, wherein the attaching device comprises a pressing installation for pressing the at least one adhesive tape piece onto the material web.

14. The method according to claim 12, wherein the attaching device comprises a release-cover winding installation for winding a release cover of the at least one adhesive tape piece.

15. The method according to claim 1, wherein the material web conjointly with the at least one adhesive tape piece when introducing the material web into the corrugating device is entrained over an angular range between 160° and 270° about a rotation axis of the corrugating roller.

16. The method according to claim 1, wherein the material web when introducing the material web into the corrugating device, downstream of a glue gap for gluing the material web and of a pressing gap for pressing the material web provided with glue and a further material web on each other, while forming a corrugated paperboard web laminated on one side, is removed from the corrugating roller by means of the discharged further material web.

17. The method according to claim 1, wherein, upon activating the second adhesive face, a maximum adhesive force which is less than an adhesive force between the material web and a further material web adhesively bonded to said material web is present between the second adhesive face and the corrugating roller.

18. A method for introducing a material web into a corrugating device having a corrugating roller for generating from the material web a corrugated web having a corrugation, the method comprising the steps:

attaching at least one double-sided adhesive tape piece which has a first adhesive face and a second adhesive face that is opposite the first adhesive face to the material web by means of the first adhesive face upstream of the corrugating device in terms of a transportation direction of the material web; and guiding the material web through the corrugating device in such a manner that the second adhesive face adheres to the rotating corrugating roller while entraining the material web for introducing the material web, wherein the second adhesive face is fused by means of heat.

19. A method for introducing a material web into a corrugating device having a corrugating roller for generating from the material web a corrugated web having a corrugation, the method comprising the steps:

attaching at least one double-sided adhesive tape piece which has a first adhesive face and a second adhesive face that is opposite the first adhesive face to the material web by means of the first adhesive face upstream of the corrugating device in terms of a transportation direction of the material web; and guiding the material web through the corrugating device in such a manner that the second adhesive face adheres to the rotating corrugating roller while entraining the material web for introducing the material web, wherein the corrugating roller has an external temperature such that the second adhesive face is fused.

* * * * *